US005462319A

United States Patent [19]

Roden, Jr.; Ralph V.

[11] Patent Number: 5,462,319

[45] Date of Patent: Oct. 31, 1995

[54] LOCK FOR INSWINGING DOORS

[76] Inventor: Ralph V. Roden, Jr., P.O. Box 8276, Fort Worth, Tex. 76124

[21] Appl. No.: 262,028

[22] Filed: Jun. 17, 1994

[51] Int. Cl.[6] ..... E05C 17/36

[52] U.S. Cl. ..... 292/264; 292/285

[58] Field of Search ..... 292/264, 289, 292/292, 293, 294, 290, 285

[56] References Cited

U.S. PATENT DOCUMENTS

| | | | |
|---|---|---|---|
| 393,163 | 11/1888 | Lee | 292/285 |
| 866,548 | 9/1907 | Wilkinson | 292/292 |
| 4,106,800 | 8/1978 | Nakanishi | 292/264 |
| 4,856,831 | 8/1989 | Roden, Jr. | 292/259 |
| 5,098,142 | 11/1991 | Fontenot | 292/292 |

FOREIGN PATENT DOCUMENTS

| | | | |
|---|---|---|---|
| 2187498 | 9/1987 | United Kingdom | 292/264 |

*Primary Examiner*—Rodney M. Lindsey
*Attorney, Agent, or Firm*—Jacobson, Price, Holman & Stern

[57] ABSTRACT

A lock for an inswinging door which includes a retainer plate secured to the door jamb by elongated screws extending into and securely anchored to a wall stud or other secure anchor internally of a wall structure. The retaining plate is relatively thin and is positioned between the free edge of the inswinging door and the door jamb with an end edge thereof projecting inwardly beyond the inner surface of the door and door jamb for receiving a locking plate. The end of the retaining plate and locking plate include a unique interrelationship in order that the locking plate can be positioned on the retaining plate in a secure but readily assembled and releasable manner with a substantial portion of the locking plate overlying the inner surface of the door and another substantial portion of the locking plate overlying the door jamb. The locking plate is circular and has a central opening and a lateral passageway communicating therewith for supporting engagement with the inner end portion of the retaining plate and rotatable into locking position. A tether chain is attached to a portion of the locking plate and to a wall bracket with upward force exerted on the tether chain causing rotational movement of the locking plate to automatically release the locking plate from the retaining plate thereby enabling rapid removal of the locking plate from its locking position in the event of an emergency and also enabling handicapped persons and young children to easily release the locking plate.

13 Claims, 2 Drawing Sheets

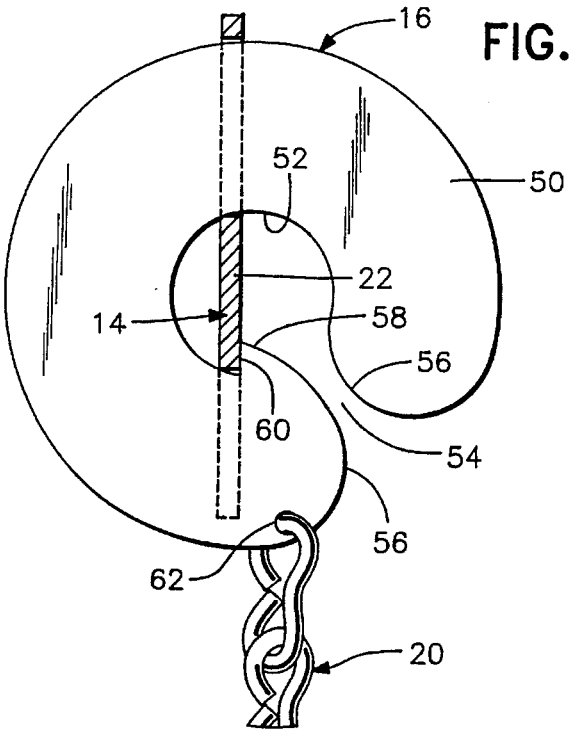
FIG. 2
FIG. 3
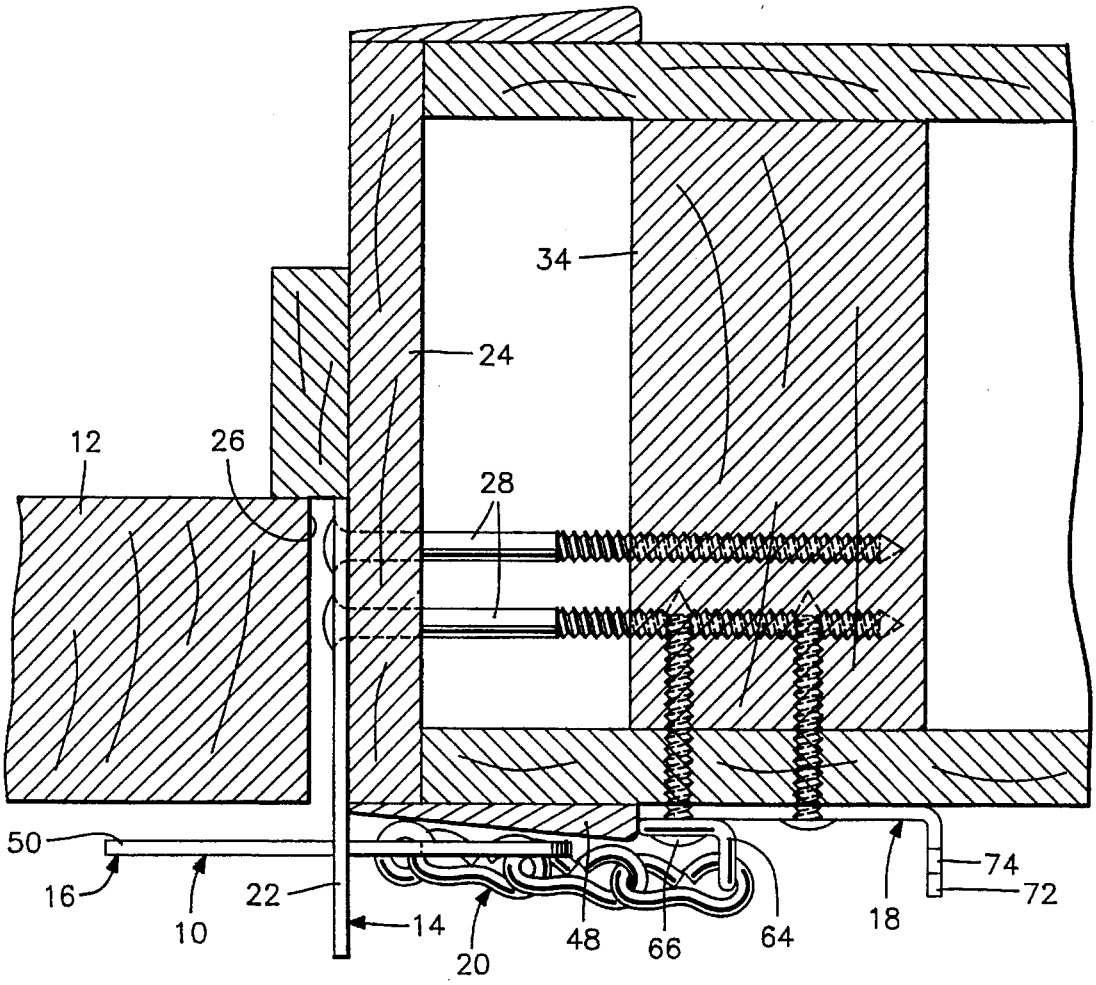

LOCK FOR INSWINGING DOORS

BACKGROUND OF THE INVENTION

1. Field of the Invention

The present invention generally relates to a lock for an inswinging door which includes a retainer plate secured to the door jamb by elongated screws extending into and securely anchored to a wall stud or other secure anchor internally of a wall structure. The retaining plate is relatively thin and is positioned between the free edge of the inswinging door and the door jamb with an end edge thereof projecting inwardly beyond the inner surface of the door and door jamb for receiving a locking plate with the end of the retaining plate and locking plate including a unique interrelationship in order that the locking plate can be positioned on the retaining plate in a secure but readily assembled and releasable manner with a substantial portion of the locking plate overlying the inner surface of the door and another substantial portion of the locking plate overlying the door jamb, trim or adjacent wall surface. The locking plate is circular and has a central opening and a lateral passageway communicating therewith for assembly onto the inner end portion of the retaining plate and being rotatable into locking position. A tether chain is attached to a portion of the locking plate and to a wall bracket with upward force exerted on the tether chain causing rotational movement of the locking plate to automatically release the locking plate from the retaining plate thereby enabling rapid removal of the locking plate from its locking position in the event of an emergency and also enabling handicapped persons and young children to easily release the locking plate.

2. Description of the Prior Art

Many efforts have been made to provide a secure locking apparatus for access doors including various type of key operated locks, dead bolt latches and the like to enable property owners to lock a door as they leave the premises of a property and then gain access when returning by unlocking the door. In addition, various apparatuses have been provided to secure an inswinging door in a closed position when the occupants of a room or dwelling are within the room or dwelling. Some devices of this type include a slide bolt mounted on the inner surface of the door having an end which slides into a keeper mounted on the door frame. However, such devices are only as strong as the door frame and the door and can be easily rendered ineffective by inward force being exerted on the door. Various other efforts have been made to provide security for occupants of a room, apartment or the like by providing a bar which extends completely across the door and has the ends thereof connected to the door frame or wall structure such as disclosed in my prior U.S. Pat. No. 4,856,831 issued Aug. 15, 1989. Also, prior U.S. Pat. No. 5,098,192 issued Nov. 26, 1991 discloses a retaining plate attached to the door jamb with a generally cylindrical enlargement at its inner end together with a slotted locking plate that is positioned on the retaining plate and held in place by the enlargement on the inner end of the retaining plate. This patent and the prior art cited therein which are incorporated herein by reference thereto disclose various locking devices which are relevant to the present invention but are not pertinent to the specific unique structural and functional features of this invention.

SUMMARY OF THE INVENTION

An object of the invention is to provide a lock for an inswinging door that is a very strong deterrent to forced entry through access doors to a home or apartment and includes a retaining plate affixed to the door jamb and the wall stud or studs which support the wall and door frame combined with a locking plate which is releasably connected to an inner end of the retaining plate with portions of the locking plate overlying or overlapping adjacent interior surfaces of the door and door frame or wall.

Another of the invention is to provide a lock for inswinging doors in accordance with the preceding object in which the retaining plate includes a unique orientation of slots to interlockingly engage with a locking plate of circular configuration having a large central hole and a radial access passageway which is interlockingly engaged with and separated from the retaining plate by partial rotational movement of the locking plate.

A further object of the invention is to provide a lock for inswinging doors in accordance with the preceding objects in which the locking plate is provided with a tether chain connected to a supporting bracket in which the weight of the tether chain normally helps to retain the locking plate in locked relation to the retaining plate but enables pivotal or rotational movement of the locking plate when the slack portion of the tether chain is moved upwardly thereby disconnecting the locking plate from the retaining plate to facilitate unlocking of the door by handicapped persons, young children and during an emergency situation by facilitating operation of the lock in an expedient and dependable manner.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 2 is a vertical sectional view of the retaining plate illustrating the locking plate associated therewith in locked position.

FIG. 3 is a horizontal sectional view taken along section line 3—3 on FIG. 1 illustrating the association of the door, door jamb, wall stud and lock of the present invention.

DESCRIPTION OF THE PREFERRED EMBODIMENT

Figure 1:
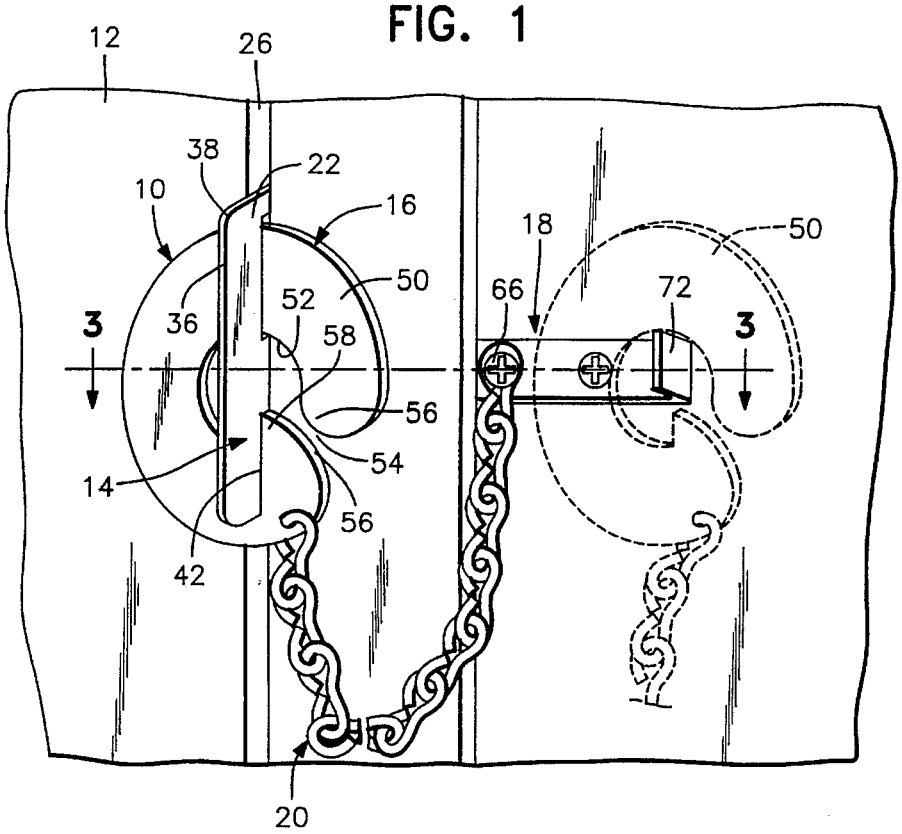
FIG. 1 is a perspective view illustrating the lock for inswinging doors oriented in locking position in relation to a door, door jamb and wall and illustrating the locking plate, in broken lines, in a stored position on a wall bracket.

Referring specifically to the drawings, the lock of the present invention is generally designated by reference numeral 10 and is associated with an inswinging door 12 for the purpose of preventing unauthorized access to a room, apartment, office, home or other enclosed space when an occupant is within the confines of the enclosed space. The lock includes a retaining plate 14, a locking plate 16, a storage bracket 18 and a tether and actuating chain 20 interconnecting the storage bracket 18 and the locking plate 16.

Figure 4:
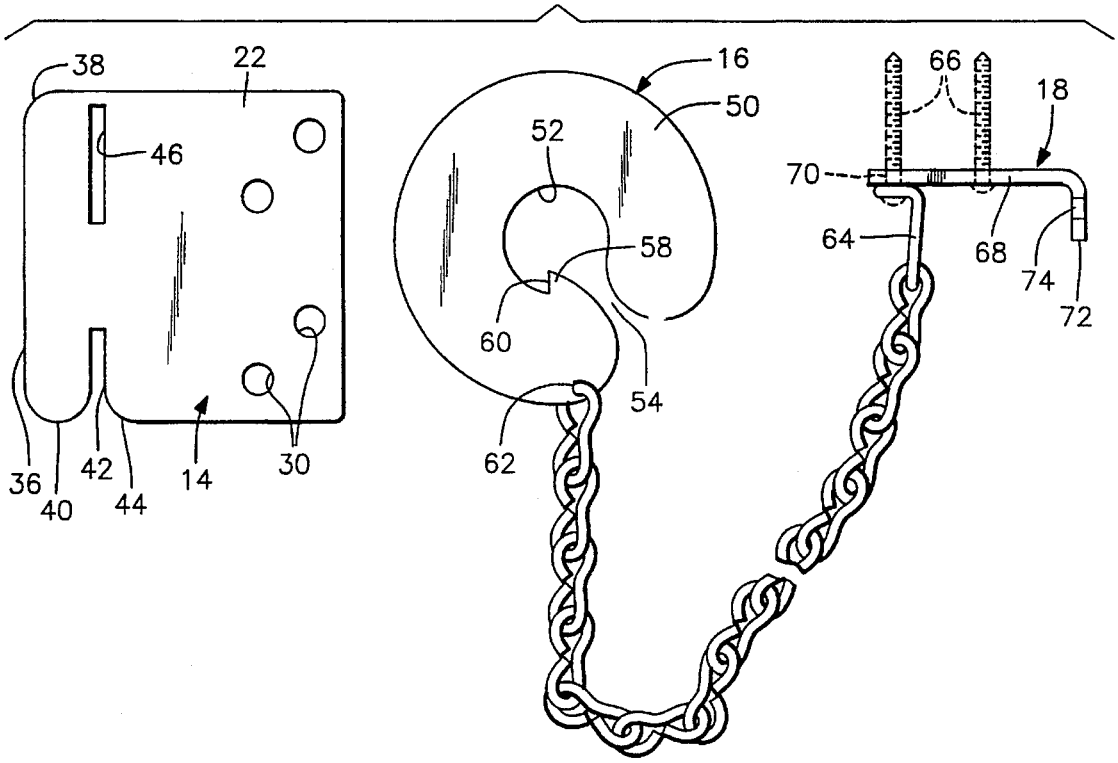
FIG. 4 is an exploded view illustrating the components of the present invention.

The retaining plate 14 is a generally rectangular, rigid metal plate of relatively thin construction as designated by reference numeral 22 for positioning against the door jamb 24 in opposed relation to the side edge 26 of the door. The plate 22 preferably is mortised into the surface of the door jamb 24 or it can be secured to the surface of the door jamb 24. Elongated mounting screws 28 extend through openings 30 in the plate 22 and extend through the door jamb or door frame into a supporting wall stud or studs 34 thereby connecting the retaining plate 12 to the wall stud rather than only to the door jamb or door frame thus providing the retaining plate with the strength of the wall structure rather than only the door frame or door jamb. The inner end edge 36 of the plate 22 has a rounded upper corner 38 and a generally semicircular lower end 40 which forms a continuation of one wall of a vertically extending notch or slot 42 in the bottom edge of the plate 22. The opposite side of the slot or notch 42 is also rounded as at 44. Spaced above and in alignment with the slot 42 and terminating in spaced relation to the upper edge of the plate 22 is a slot 46 with the lower end of the slot 46 terminating in spaced relation to the upper end of the slot or notch 42 with the upper end of the slot 46 terminating below the top edge of the plate 22 as illustrated in the drawings. The retaining plate 14 is oriented in relation to the door frame and door jamb and the door so that the slots 42 and 46 are positioned just inwardly of the interior surface of the door and the interior surface of the door frame or door jamb or trim member 48 as illustrated in FIGS. 1 and 3. The locking plate 16 is in the form of a circular metal plate 50 having a centrally disposed opening or hole 52 extending therethrough and a radial or lateral slot or passageway 54 extending from the outer periphery of the circular metal plate 50 to the interior opening as illustrated in FIGS. 2 and 4. Thus, the metal plate 50 is generally annular in configuration with the facing edges of the slot or passageway 54 being generally smoothly curved as at 56. The lower curved edge 56 extends inwardly at a different degree of curvature and terminates in an end point 58 which defines a radial shoulder 60 extending from the point 58 to the inner surface of the opening or hole 52 as illustrated in FIGS. 3 and 4.

The tether chain 20 is a link chain having one end link connected to a small opening 62 at the outer edge of the circular metal plate 50 and adjacent the curved surface 56 which terminates in the point 58 and shoulder 60. The other end of the tether chain 20 is provided with a connecting link 64 which receives a mounting screw 66 therethrough for the storage bracket 18 which is in the form of metal strap 68 provided with spaced aperture 70 receiving two mounting screws 66 which extend into the wall or supporting studs. The end of the mounting strap or bar 68 remote from the door frame trim 48 is oriented in perpendicular relation to the remainder of the strap 68 as indicted by reference numeral 72 and the top and bottom edges thereof have a shallow recess or notch 74 formed therein on which the locking plate 16 can be stored as indicated in broken line in FIG. 1 with the notch or recess retaining the locking plate on the storage bracket 18 during periods of non-use such as when no one is occupying the room, apartment or enclosed space.

Installation of the lock is quite simple in that the retaining plate 14 is preferably installed in a mortised area in the door jamb inwardly of the door stop 25 on the door jamb 24 and is secured in place by elongated screws which extend into the stud 34 with the notch 42 oriented downwardly and with the notches 42 and 46 oriented just inwardly of the interior surface of the door 12 and the door frame or jamb 24 and the interior trim 48 as illustrated in FIG. 1 so that the slots 42 and 46 are accessible to engage the locking plate 16 with the retaining plate 14. The locking plate is positioned below the retaining plate 14 so that the entrance passageway or slot 54 is aligned with the notch 42 and moved upwardly until the inner edge of the opening 52 opposite to the passageway or notch 54 enters the notch 42 and engages the upper edge thereof. The locking plate 16 can then be rotated or pivoted in a clockwise direction to move the rounded end 56 of the locking plate 50, opposite the curved end having the point 58 thereon, through the notch 46 with such rotation continuing until the shoulder 60 comes into contact with the surface of the retaining plate 14 immediately above the upper end of the slot 42 as illustrated in FIG. 2 which is the locking position of the locking plate 16. The rounded end 56 of the plate 50 having the point 58 and the chain 20 attached thereto cannot move through the slot 46 due to the dimensional characteristics of the rounded end 56 and the distance between the point 58 and the opposed edge of the opening 52. Thus, the locking plate 16 can only be rotated in one direction to move to its locking position in relation to the retaining plate. In this position, a substantial portion of the locking plate overlies the door 12 and a substantial portion overlies the door frame and trim as illustrated in FIGS. 1 and 3 thus preventing inward swinging movement of the door 12 when the locking plate is assembled onto the retaining plate and moved to its locking position as illustrated in FIGS. 1–3.

As illustrated in FIG. 1, the storage bracket enables the locking plate 14 to be stored in a readily accessible position and provides a convenient storage place for the locking plate when the occupant leaves the room or apartment. Also, the tethered chain functions to hold the locking plate in its locking position during any attempt to move the locking plate to an unlocked position by jiggling or shaking the door due to the weight of the chain. The tether chain also retains the locking plate in the event it becomes dislodged from the storage bracket or from the retaining plate. A very important function of the tether chain is to facilitate removal of the locking plate from the retaining plate by a person engaging and lifting the central portion of the flexible chain. This facilitates removal of the locking plate by handicapped persons, young children and by anyone during an emergency or panic situation when it may become desirable to rapidly egress from the apartment, home or enclosed space by simply lifting up on the chain which will rotate the locking plate in a counterclockwise direction to a position that gravity will cause the locking plate to drop off of the retaining plate thus unlocking the inswinging door.

The components of the lock may be colored, anodized or otherwise decorated to be compatible with decorative motifs of the interior surfaces of the door and wall thereby rendering the device attractive in appearance as well as providing effective security for occupants of a home, apartment or other enclosed space.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A lock for a closure member having an edge portion and a surface portion extending laterally from the edge portion, said closure member being laterally movably associated with a stationary frame defining an opening, said closure member being moveable between a closed position generally aligned with the stationary frame and closing the opening and an open position with the edge portion of the closure member spaced laterally from the frame, said stationary frame having a surface in opposed adjacent relation to said edge portion of the closure member when the closure member is in closed position and a surface area generally in alignment with said surface portion of said closure member when the closure member is in closed position, said lock comprising a retaining member, means mounting said retaining member on said frame surface in opposed relation to said edge portion of said closure member, said retaining member extending laterally beyond said surface portion of the closure member and beyond the surface area on the frame, and a locking member, means mounting said locking member on said retaining member with the locking member extending into overlying relation to said surface portion of said closure member to prevent lateral movement of said closure member from its closed position, said locking member also extending into overlying relation to said surface area of said frame whereby the locking member will engage the surface portion of the closure member and the surface area of the frame to prevent lateral movement of the closure member from its closed position, said retaining member being a retaining plate and said locking member being a locking plate and means mounting the locking plate on the retaining plate to enable movement of the locking plate to a position enabling lateral movement of the closure member toward open position, said means mounting the locking plate on the retaining plate including means enabling separation of the locking plate from the retaining plate, said means mounting the locking plate on the retaining plate including slot means in said retaining plate oriented in laterally spaced but adjacent relation to the surface portion of the closure member and the surface area of the frame when the closure member is in closed position, said locking plate including means positionable through the slot means to removably mount the locking plate on the retaining plate, said slot means including a closed end slot through said retaining plate and an open ended slot through said retaining plate with the two slots being aligned and spaced from each other and the open ended slot having its open end at a bottom edge of said retaining plate, said locking plate being a circular plate having a generally circular central opening, a radial passageway extending between an outer periphery of the circular plate and the periphery of the opening, said passageway being defined by generally convexly curved end edges of said circular plate defining said passageway, the distance between the inner edge of the open ended slot and the adjacent end of the closed slot being slightly less than the diameter of the opening in the locking plate and the thickness of the retaining plate being less than the width of the radial passageway from the periphery of the locking plate to the opening in the locking plate to enable the locking plate to be connected to the retaining plate by aligning the passageway in the locking plate with the open ended notch and moving the locking plate toward the retaining plate until the end edge defining the passageway aligns with the closed slot and then rotating the locking plate until the passageway is misaligned in relation to the retaining plate.

2. The lock as defined in claim 1 wherein one curved end edge of the locking plate defining the passageway is extended inwardly beyond the periphery of the opening through the locking plate to define a radially extending shoulder extending inwardly from the periphery of the opening to limit the rotational movement of the locking plate in relation to the retaining plate to a locked position with the shoulder engaging the surface of the retaining plate at the inner end of the open slot.

3. The lock as defined in claim 2 together with a flexible member connected to an outer peripheral portion of said locking plate adjacent the curved end edge having the radial shoulder formed thereon to retain the locking plate engaged with the retaining plate when the locking plate is engaged by the closure member to prevent accidental separation of the locking plate.

4. The lock as defined in claim 3 together with a storage bracket for said locking plate mounted on said surface area of the frame, said flexible member connected to the locking plate being connected to said storage bracket to support the locking plate when separated from the retaining plate, said flexible member having a length in excess of the distance between the storage bracket and the locking plate when the locking plate is mounted on the retaining plate to enable separation of the locking plate by rotating the locking plate in a direction opposite to the rotational direction when assembling the locking plate on the retaining plate by engaging the flexible member and moving it toward the edge of the retaining plate having the open ended slot therein.

5. The lock as defined in claim 4 wherein said storage bracket includes a projecting flange having a recess in an edge thereof to engage a portion of the periphery of the opening in the locking plate when the locking plate is supported on the storage bracket.

6. The lock as defined in claim 5 wherein said closure member is a pivotal, inswinging door and said stationary frame is a door frame having a door stop thereon.

7. The lock as defined in claim 6 wherein said frame is mounted in a wall having a supporting stud, said means mounting said retaining member including a plurality of elongated screws extending through said retaining plate and into said stud whereby the retaining plate is fixedly connected to said stud to eliminate the possibility of the retaining plate being dislodged by exerting a force sufficient to rupture said frame.

8. The lock as defined in claim 7 wherein said remaining plate is a metal plate mortised into said frame, the retaining plate having rounded corners inwardly of the inswinging door and frame to facilitate assembly of the locking plate thereon.

9. The lock as defined in claim 8 wherein said storage bracket is generally aligned with the retaining plate, said flexible member being a flexible chain to provide a gravitational force to the locking plate to retain it in locked position with the central portion of the chain hanging downwardly to enable a handicapped person or young child to separate the locking plate by engaging and lifting upwardly on the central portion of the chain thus rotating the locking plate to a position for gravitational disengagement from the retaining plate.

10. A lock for an inswinging door having an edge portion and a surface portion extending laterally from the edge portion, said door being laterally movably associated with a stationary door frame defining an opening in a wall, said door being moveable between a closed position generally aligned with the door frame and an open position with the edge portion of the door spaced laterally from the door frame, said door frame having a surface in opposed adjacent relation to said edge portion of the door when the door is in closed position and a surface area generally in alignment with said surface portion of said door when the door is in closed position, said lock comprising a retaining plate, means mounting said retaining plate on said door frame surface in opposed relation to said edge portion of said door, said retaining plate extending laterally beyond said surface portion of the door and extending laterally beyond the surface area of the door frame, a locking plate, means mounting said locking plate on said retaining plate with the locking plate extending into overlying relation to said surface portion of said door to prevent lateral movement of said door from its closed position, said locking plate also extending into overlying relation to said surface area of said door frame whereby the locking plate will engage the surface portion of the door and the surface area of the door frame to prevent lateral movement of the door from its closed position, said means mounting the locking plate on the retaining plate including a pair of slots in said retaining plate oriented in laterally spaced but adjacent relation to the surface portion of the door and the surface area of the door frame when the door is in closed position, said locking plate including means positionable in said slots to removably mount the locking plate on the retaining plate, said slots being vertically aligned and spaced from each other, said locking plate being an annular plate having a generally circular open center, a radial passageway extending between an outer periphery of the annular plate and the periphery of the open center, one end edge of the locking plate defining the passageway extending inwardly beyond the periphery of the open center in the locking plate to define a radially extending shoulder extending inwardly from the periphery of the open center to engage the retaining plate to limit the rotational movement of the locking plate in one direction in relation to the retaining plate to a position with the shoulder engaging the surface of the retaining plate at the inner end of one of said slots.

11. The lock as defined in claim 10 together with a flexible chain connected to an outer peripheral portion of said locking plate adjacent the end edge having the radial shoulder formed thereon to retain the shoulder against the retaining plate by the weight of said chain to maintain the locking plate engaged with the retaining plate when the locking plate is engaged by the door to prevent accidental separation of the locking plate from the retaining plate.

12. The lock as defined in claim 11 together with a bracket for said locking plate mounted on said surface area of the door frame, said flexible chain connected to the locking plate being connected to said bracket to support the locking plate when separated from the retaining plate, said flexible chain having a length in excess of the distance between the bracket and the locking plate to form a downwardly hanging loop in the chain when the locking plate is mounted on the retaining plate to enable separation of the locking plate by rotating the locking plate in a direction opposite to the rotational direction when assembling the locking plate on the retaining plate by engaging the flexible chain and moving it toward the retaining plate.

13. The lock as defined in claim 12 wherein said bracket is generally aligned with the retaining plate, said flexible chain loop providing a gravitational force on the locking plate to retain it in locked position with the central portion of the chain hanging downwardly to enable a handicapped person or young child to separate the locking plate from the retaining plate by engaging and lifting upwardly on the central portion of downwardly hanging loop in the chain thus rotating the locking plate to a position with the passageway in the locking plate opening upwardly and aligned with the retaining plate for gravitational disengagement of the locking plate from the retaining plate.

* * * * *